US009527659B2

(12) United States Patent
Fosbury et al.

(10) Patent No.: US 9,527,659 B2
(45) Date of Patent: Dec. 27, 2016

(54) MAILABLE PACKAGING OF COMPRESSED GARMENTS AND OTHER ITEMS

(75) Inventors: Mark Andrew Fosbury, London (GB); Akio Morishima, London (GB)

(73) Assignee: SILVERFLINT LIMITED, London (GB)

( * ) Notice: Subject to any disclaimer, the term of this patent is extended or adjusted under 35 U.S.C. 154(b) by 0 days.

(21) Appl. No.: 14/115,846

(22) PCT Filed: May 4, 2012

(86) PCT No.: PCT/GB2012/050984
§ 371 (c)(1),
(2), (4) Date: Jan. 14, 2014

(87) PCT Pub. No.: WO2012/150464
PCT Pub. Date: Nov. 8, 2012

(65) Prior Publication Data

US 2014/0116904 A1 May 1, 2014

(30) Foreign Application Priority Data

May 5, 2011 (GB) ..... 1107512.4

(51) Int. Cl.

| | |
|---|---|
| ***B65D 85/18*** | (2006.01) |
| ***B65D 5/20*** | (2006.01) |
| ***B65D 5/24*** | (2006.01) |
| ***B65D 5/42*** | (2006.01) |
| ***B65D 77/00*** | (2006.01) |
| ***B65D 77/02*** | (2006.01) |
| ***B65D 77/04*** | (2006.01) |
| *B42D 15/02* | (2006.01) |

(52) U.S. Cl.
CPC ..... *B65D 85/18* (2013.01); *B65D 5/2052* (2013.01); *B65D 5/248* (2013.01); *B65D 5/4204* (2013.01); *B65D 5/4212* (2013.01); *B65D 5/4233* (2013.01); *B65D 5/4245* (2013.01); *B65D 77/003* (2013.01); *B65D 77/02* (2013.01); *B65D 77/0433* (2013.01); *B42D 15/02* (2013.01)

(58) Field of Classification Search
CPC ..... B65D 85/18; B65D 5/2052; B65D 5/248
USPC ..... 206/28, 459.5, 754, 281, 299; 229/87.15–87.17, 103.3, 921, 930, 942, 229/92; 383/98.99; 190/107
See application file for complete search history.

(56) References Cited

U.S. PATENT DOCUMENTS 1,905,793 A * 4/1933 Buckingham ..... 223/71
2,097,708 A * 11/1937 Trost ..... 229/144
2,371,841 A * 3/1945 Paulsen ..... 206/299
(Continued)

FOREIGN PATENT DOCUMENTS

DE 954042 C 12/1956
DE 298 04 948 U1 9/1998
(Continued)

OTHER PUBLICATIONS

UK office action dated May 8, 2014, as received in Application No. GB1107512.4.

*Primary Examiner* — Sue A Weaver
(74) *Attorney, Agent, or Firm* — Maschoff Brennan

(57) ABSTRACT

A retail-ready garment package (1) adapted for mailing, comprising a compressed garment (17) in the form of a flat tablet having self-supporting rigidity, the package having opposed major faces (3,5) joined by an edge portion (7), and an address surface on at least one of the major faces for providing a mailing address of an intended recipient.

41 Claims, 18 Drawing Sheets

(56) References Cited

U.S. PATENT DOCUMENTS

| | | | | | |
|---|---|---|---|---|---|
| 3,690,542 | A | * | 9/1972 | Jernstrom | 206/459.5 |
| 5,166,851 | A | * | 11/1992 | Jacobson | 360/137 |
| 5,605,278 | A | * | 2/1997 | Jensen | 229/103.2 |
| 6,021,626 | A | | 2/2000 | Goodman | |
| 6,241,084 | B1 | | 6/2001 | Gyr | |
| 2005/0247769 | A1 | * | 11/2005 | Potter et al. | 229/305 |
| 2006/0283922 | A1 | | 12/2006 | Hurwitz | |
| 2009/0197231 | A1 | * | 8/2009 | Sosalla | 434/267 |
| 2009/0301921 | A1 | * | 12/2009 | Kidwell | 206/459.5 |

FOREIGN PATENT DOCUMENTS

| | | | |
|---|---|---|---|
| EP | 2276673 | S1 | 1/2011 |
| GB | 504528 | A | 4/1939 |
| GB | 681406 | A | 10/1952 |
| GB | 2 101 040 | A | 1/1983 |
| GB | 2 304 624 | A | 3/1997 |
| GB | 2 393 421 | A | 3/2004 |
| WO | 99/47364 | | 9/1999 |
| WO | 2004/106181 | A | 12/2004 |

* cited by examiner

MAILABLE PACKAGING OF COMPRESSED GARMENTS AND OTHER ITEMS

TECHNICAL FIELD

The present invention relates to the field of packaging and in particular to improved, low cost, commercially-appealing mailable packaging for garments and other items.

BACKGROUND

For stockpiling and transport purposes, clothing is usually stored in a folded or hung state, sometimes with some protective packaging. This means that the storage area and transportation requirements of a clothing distributor or retailer are high. Also, clothing displays occupy a substantial floor area that must be dedicated largely or exclusively to the display of clothing. Such considerations limit the types of retail store in which clothing may be sold and the locations within retail stores at which clothing may be displayed.

Conventionally, impulse purchase items are located at or near the point of sale, near store tills or cash registers where space and browsing opportunities are typically limited. For example, impulse purchase items are often displayed on stands, such as racks or carousel stands, located at or near the point of sale. It follows that impulse purchase items need to be compact and easy to browse and to handle.

In their normal folded or hung form, articles of clothing are not ideally suited for display as an impulse purchase item near the point of sale. They require specialised storage and display installations such as clothing racks and shelf units, which take up a lot of space and cannot easily be browsed by shoppers queuing near the cash registers of a store.

One possible solution to this problem is proposed in U.S. Pat. No. 6,021,626. This discloses a standard beverage vending machine, adapted to dispense containers shaped like drinks cans but containing compressed articles of clothing such as T-shirts packaged. This increases the density of clothing items stored in a given floor area but the vending machine itself occupies significant space and is not suitable for use in all scenarios. Also, a vending machine does not lend itself to browsing the items within.

The proposal in U.S. Pat. No. 6,021,626 has novelty value but little else. A more effective known solution comprises articles of clothing such as T-shirts compressed into a small shrink-wrapped cube with a side of about 50 mm. An array of such cubes may be stored and displayed in an advantageously compact display unit near the point of sale or at another location within a store such as the end of an aisle. This significantly increases the number of garments that may be displayed per unit storage area and/or volume, and also reduces storage and transport costs.

A significant shortcoming of this and other known retail-ready packaging solutions is their unsuitability for mailing. Known solutions require the consumer to repackage retail-ready packaged goods in mailable parcels and/or other packaging, prior to mailing. The additional cost and time required of the consumer in carrying out these additional actions are inconveniences and barriers to impulse purchase, particularly for gift purposes.

In particular, a consumer wishing to mail a purchased article such as a garment to a recipient is required to purchase additional mailable packaging for the article, and to purchase postage separately. Such mailable packaging will usually have to be bought from a different retail store than where the article was purchased. For example, a consumer that has purchased a garment from a clothing store intended to be mailed to a recipient must subsequently go to a stationery store and/or a post office to purchase a mailable package for the garment and to pay for the necessary postage. Also, such a package is generally classed as a parcel and this necessitates a visit to a post office or other parcel depot to hand the package over.

The whole process is inconvenient and may therefore deter the consumer from purchasing the garment. A further consideration is that the associated cost of such mailable packaging may also be difficult for the consumer to justify, where the value of the garment is relatively low compared to the cost of the packaging. This may particularly be the case for a low-cost impulse-bought article.

The cost of known mailable packaging solutions is in part dictated by their manufacturing cost. Known mailable packages are made from several pieces of material cut into complex shapes and assembled in multiple steps, which increase manufacturing complexity and the associated manufacturing costs. For example, a rectangular package is typically manufactured from a sheet of material, which is first cut into a complex shape, may optionally be glued to a second cut sheet of material, and then folded to form the rectangular package. The cutting step inevitably produces some waste material, which is inefficiently discarded.

One known solution for increasing the efficient use of packaging material is disclosed in US Patent Publication No. 2006/0283922 A1. This discloses a packet or envelope manufactured by folding a single sheet of square material. However, the disclosed packet has limited functional use: it is only suitable for packaging very small items such as pills. It is unsuitable for packaging larger objects, such as books or articles of clothing.

SUMMARY OF THE INVENTION

Against this background, a first aspect of the present invention relates to a retail-ready garment package adapted for mailing, comprising a compressed garment in the form of a flat tablet having self-supporting rigidity. The package has opposed major faces joined by an edge portion, and an address surface on at least one of the major faces for providing a mailing address of an intended recipient.

One advantage associated with the present invention is that the packaged garment is suitable for mailing in its retail-ready packaging, without requiring any further mailable packaging. Also, the compressed garment confers rigidity on the package for ease of use and handling, and for dimensional control.

Alternative embodiments comprise a customisable, removable, information-bearing insert and may also comprise a pocket arranged to receive the information-bearing insert. An advantage associated with such embodiments is that the package may be customised for the intended recipient after purchase. Such customisable features render the package ideal for use as a personalised gift.

A second aspect of the present invention relates to a package made from a folded sheet. The package comprises an open-topped storage volume bounded by a major face surrounded by an edge portion. Additionally, the package comprises at least one upper flap that is integral with, and is movable with respect to, the edge portion to cover at least part of the open top of the storage volume when in a closed configuration, and first and second lower flaps that are integral with, and are movable with respect to, the edge portion to cover at least part of the open top of the storage volume while underlying the upper flap, when in a closed configuration. The upper flap is integrally connected to the first and second lower flaps by folded interleaved elements that unfold, slide past and interact with each other in response to opening movement of the upper flap, thereby to reveal and provide access to the storage volume.

An advantage associated with this aspect of the invention is that a low cost, simple to manufacture alternative packaging solution is provided from a folded sheet of material.

A further advantage associated with this aspect of the invention is that the interleaved relationships between the various elements provide a visually-intriguing and functionally-effective way of concealing and, on opening, revealing the contents of the package.

Furthermore, the interior surface of the folded sheet may comprise a writing surface which is customisable to personalise the package for the intended recipient.

It is an objective of the present invention to overcome the shortcomings of the known prior art. In particular, it is an object of the present invention to provide a low cost, compact, retail-ready packaging solution, which is suitable for mailing. It is also an object of the present invention to provide a packaging solution that enables clothing to be sold as an impulse purchase item, in retail settings where space is severely limited.

Further optional and advantageous features and aspects of the present invention are set out in the appended claims.

DETAILED DESCRIPTION

Figure 1B:
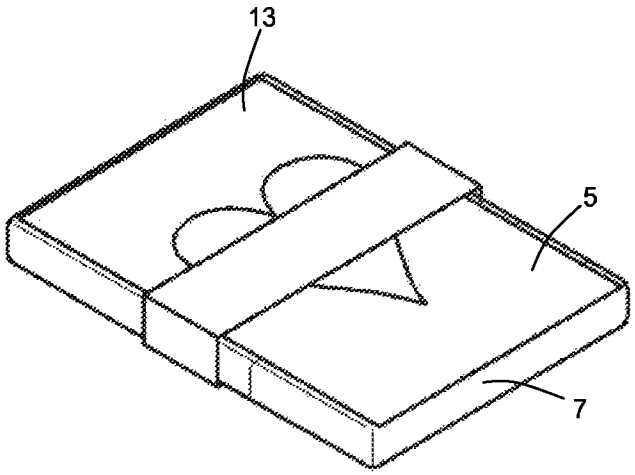
FIG. 1*b* is a perspective view of the bottom face of the mailable compressed garment package of FIG. 1.

Specific embodiments of the present invention are now described below with reference to the appended figures. Like reference numerals are used to highlight like features in different figures.

Figure 1A:
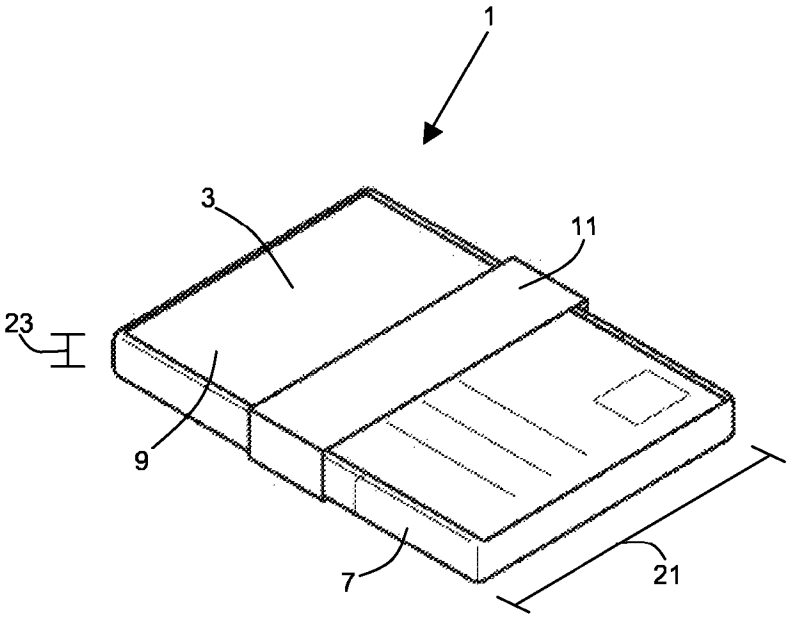
FIG. 1*a* is a perspective view of the top face of a mailable compressed garment package.

FIGS. 1*a* and 1*b* show respectively the opposed major faces of a mailable compressed garment package 1, shaped in the form of a flat tablet in accordance with an embodiment of the present invention.

FIG. 1*a* shows the top major face 3 of the compressed garment package 1, whilst FIG. 1*b* shows the bottom major face 5 opposed to the top major face 3. The opposed major faces 3, 5 are joined by an edge portion 7. A writing surface is provided on the top major face 3, suitable for entering a mailing address of an intended recipient. In the illustrated embodiment the writing surface is a postcard 9, that is suitably affixed to the compressed garment package 1 by an adhesive. The postcard 9 comprises a region suitable for entering a mailing address, in addition to a region for affixing a postal stamp or for bearing a pre-paid postage marking.

A bellyband 11 encircles the compressed garment package 1 including the postcard 9. The bellyband 11 suitably bears marketing information for retail purposes and can be removed from the compressed garment package 1 after purchase.

Optionally, as shown in FIG. 1*b*, the bottom major face 5 of the compressed garment package 1 supports an information-bearing insert 13. For example the information-bearing insert 13 may comprise indicia identifying a source of origin or other product-related information, or simply a visually-appealing design to attract consumer interest in the compressed garment package 1.

It is to be appreciated that the terms 'top major face' and 'bottom major face' are used herein merely to distinguish the two major faces. The orientation of the compressed garment package 1 is generally irrelevant. For example, at a retail point of sale, the compressed garment package 1 may be arranged such that the information-bearing insert 13 is visible to attract consumer interest. However, once purchased, the compressed garment package 1 will be inverted to present the writing surface uppermost. For consistency henceforth the major face comprising the writing surface (i.e. the postcard 9 in this example) will be referred to as the top major face, whilst the optional information-bearing insert will be referred to as being on the bottom major face where required.

Figure 2:
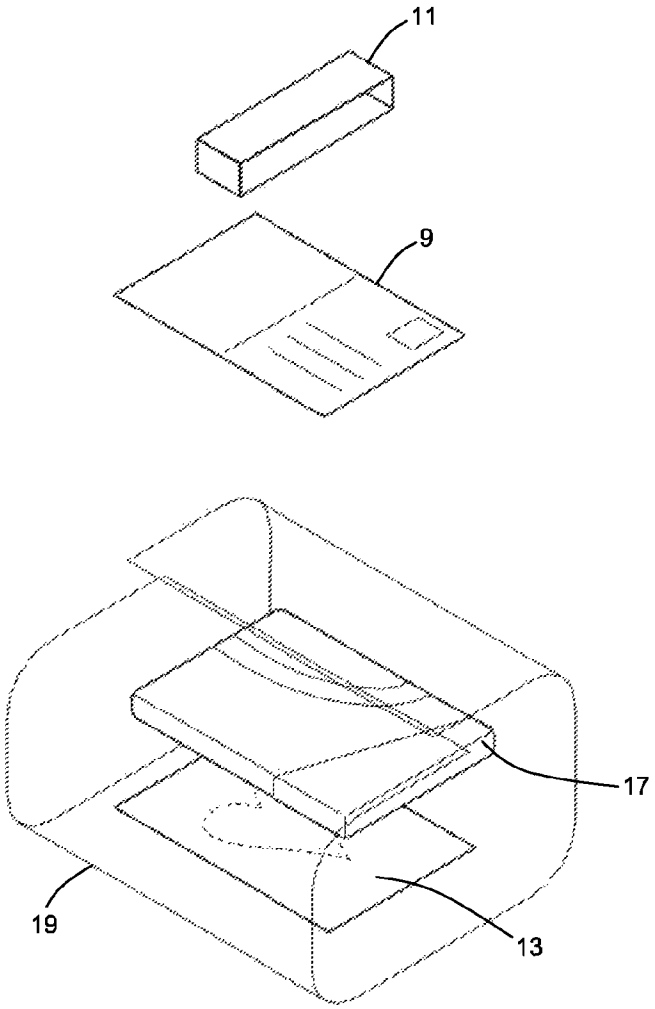
FIG. 2 is an exploded perspective view of the components of the mailable compressed garment package of FIGS. 1*a* and 1*b;*

FIG. 2 is an exploded view of the mailable compressed garment package 1 of FIGS. 1*a* and 1*b*, showing its constituent parts. A compressed garment 17 in the form of a thin rectangular flat tablet, having self-supporting rigidity is enclosed in shrink-wrap packaging 19 that tightly encloses the garment 17 to hold it in its compressed form. By 'self-supporting rigidity' is intended that the compressed garment 17 is able to support its own weight in any orientation, without deformation of its overall shape. The structural rigidity of the compressed garment package 1 is provided by the compressed garment 17, which forms a rigid tablet-shaped structure when compressed. The shrink-wrapping 19 provides an external protective layer for the compressed garment 17, which may for example be a T-shirt.

Optionally, and in place of the shrink-wrapping 10, the compressed garment may be enclosed in an alternative plastics material such as regenerated cellulose as sold under the registered trade mark 'Cellophane'. The Cellophane is tightly wrapped around the compressed garment to conform to the shape of the garment. The Cellophane is bonded using glue to maintain its shape.

The postcard 9 is subsequently affixed to the exterior of the shrink-wrap packaging 19, on the top major face 3 as shown in FIG. 1*a*. In those embodiments employing transparent shrink-wrap packaging, the information-bearing insert 13 is preferably disposed between the shrink-wrap packaging 19 and the compressed garment 17, thereby enabling the content of the information-bearing insert 13 to be viewed through the shrink-wrap packaging 19. In that case, the shrink-wrap packaging 19 advantageously protects not just the compressed garment 17 but also the information-bearing insert 13. It would of course be possible for the shrink-wrap packaging 19 itself to bear designs or other information, instead of or in addition to an information-bearing insert 13.

The physical dimensions of the compressed garment package 1 are selected to enable the package 1 to fit through the aperture of a typical postbox, without requiring any deformation of the package 1. Accordingly, the physical dimensions of the package 1 are constrained by the physical dimensions of the aperture of a postbox. In particular, the maximum width 21 of the tablet-shaped compressed garment package 1 illustrated in FIGS. 1*a* and 1*b* is selected to be less than the width of the aperture of a postbox. Similarly, the thickness 23 of the packaged garment is selected to be less than the height of the aperture of a postbox.

Figure 3:
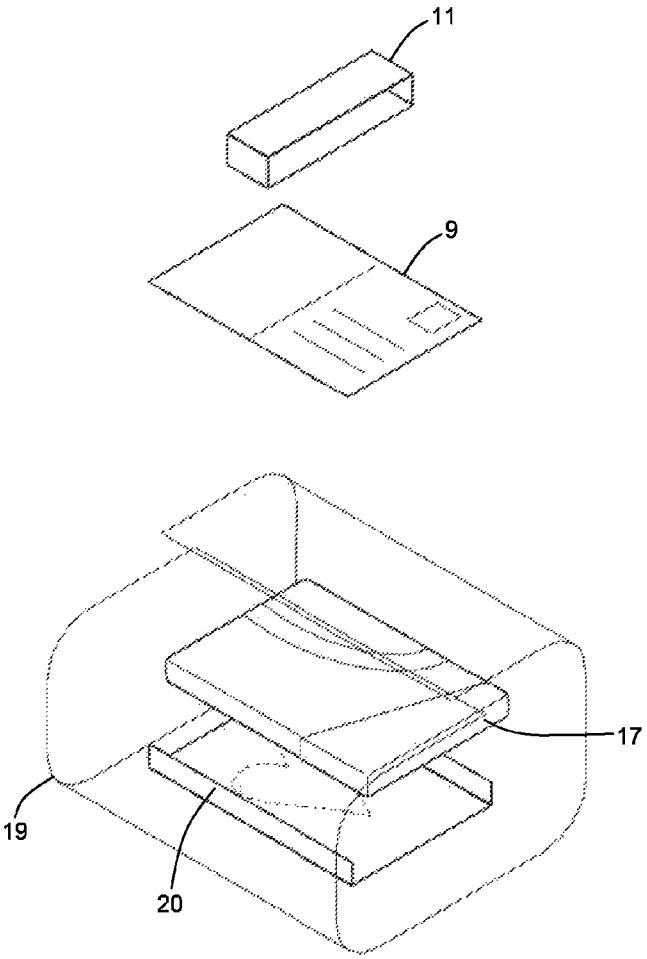
FIG. 3 is an exploded perspective view of the components of an alternative mailable compressed garment package.

Similarly, in those countries where upper limits are placed on the physical dimensions of a package for the purpose of postage rates, the maximum physical dimensions of the compressed garment package 1 may be selected accordingly. For example, in the UK the maximum dimensions of a package suitable for normal delivery using a postbox are as follows: width 250 mm; thickness 25 mm; and length 353 mm. Accordingly, in the UK, it is preferred that the physical dimensions of the compressed garment package 1 do not exceed the aforementioned values.

Where required, the compressed garment package 1 may optionally comprise a supportive tray to increase the rigidity of the package or to improve protection for the compressed garment 17. This option is shown in FIG. 3 of the drawings, which shows a tray 20 in place of the information-bearing insert 13 of the previous embodiment. The tray 20 has upturned side portions that confer additional rigidity on the tray 20 and that protect at least part of the edge portion 7 of the compressed garment 17. Like the information-bearing insert 13, the tray 20 may bear information and a design, and is suitably disposed within the shrink-wrap packaging 19. However it would be possible for the tray 20 not to bear information or a design, and to be disposed outside the shrink-wrap packaging 19.

Figure 4:
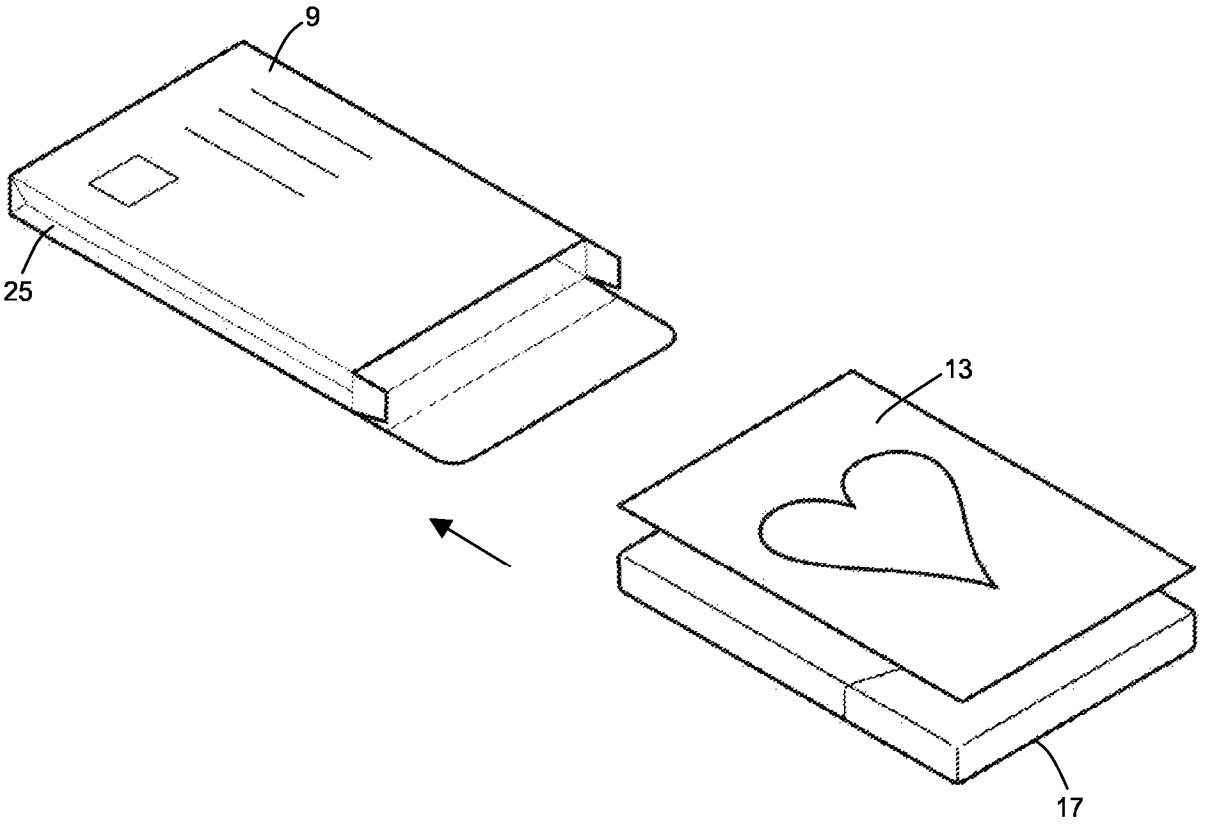
FIG. 4 is a perspective view that shows a compressed garment being inserted into an envelope.

In another embodiment as illustrated in FIG. 4, the compressed garment 17 may be packaged in a container such as an envelope 25. In such embodiments a writing surface 9 may be printed on the exterior of the envelope 25 or provided on a postcard or the like affixed to the envelope. The other major face of the envelope may be an information-bearing surface. In this example, an insert 13 is also packaged inside the envelope beside the compressed garment 17. That insert 13 may bear information and a design as shown, and may also have space for the sender to write a personal message to the recipient.

Figures 5A, 5B, 5C:
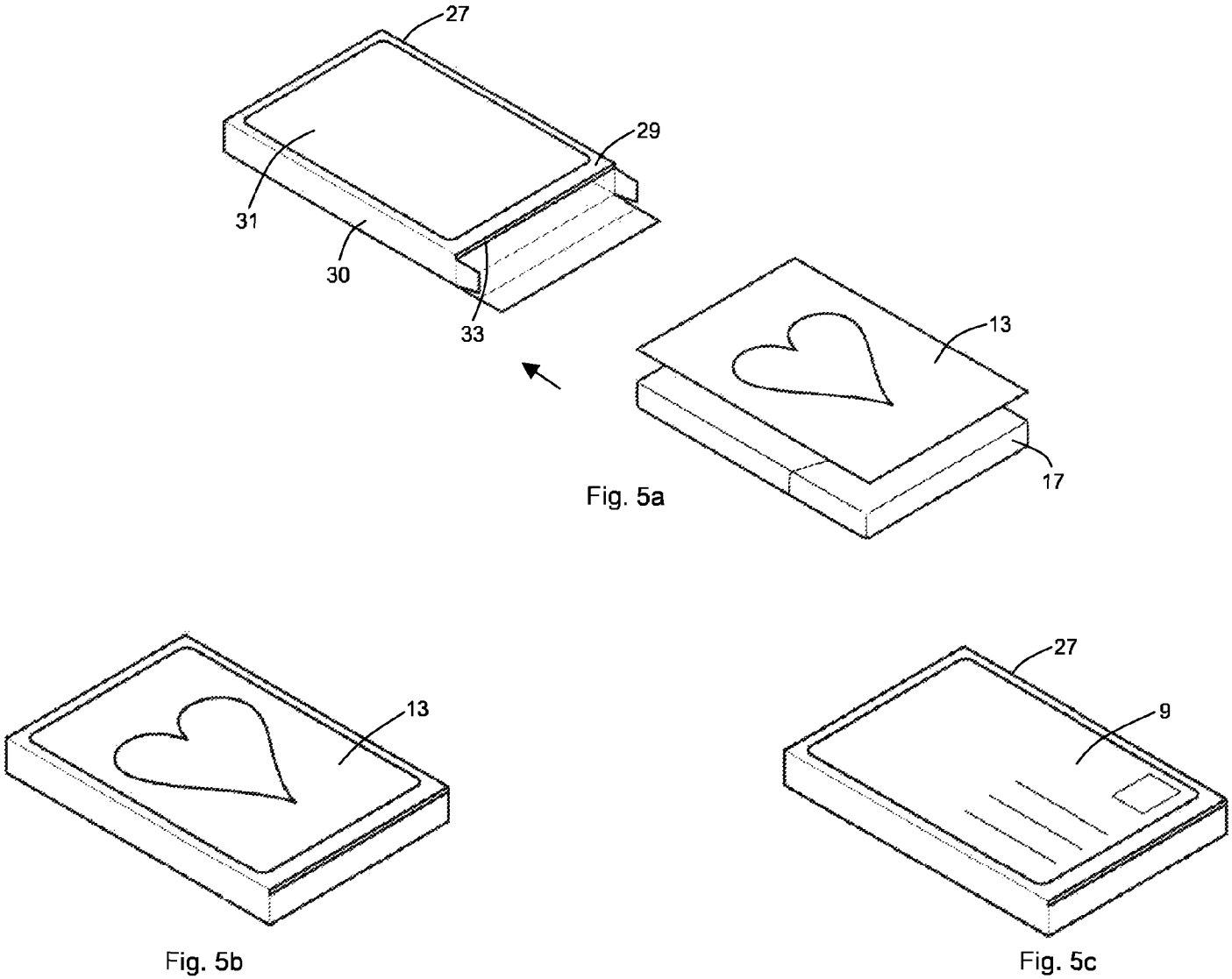
FIG. 5*a* is a perspective view that shows a compressed garment being inserted into an envelope having a windowed pocket, with an information-bearing insert being inserted into the pocket.
FIG. 5*b* is a perspective view that shows the envelope of FIG. 5*a* closed with the compressed garment inside and with the information-bearing insert displaying information through the window.
FIG. 5*c* is a perspective view that corresponds to FIG. 5*b* but shows the compressed garment packaged in the envelope of FIG. 5*a* and having the information-bearing insert reversed to display a postcard through the window.

FIGS. 5*a*, 5*b* and 5*c* illustrate a compressed garment 17 in conjunction with a windowed envelope 27 in accordance with an alternative embodiment of the present invention.

FIG. 5*a* shows the compressed garment 17 being inserted into the windowed envelope 27. The windowed envelope 27 comprises a pocket 29 disposed on a major surface of the envelope 27. The pocket 29 may be formed integrally with the envelope 27 or may be attached to it. The pocket 29 has an outwardly-facing transparent window 31, enabling the contents of the pocket 29 to be viewed through the window 31. The pocket 29 also has an opening 33 enabling access to its interior for insertion of an information-bearing insert 13 into the pocket 29 to be visible through the window 31 as shown in FIG. 5*b*.

The provision to place an information-bearing insert 13 in the pocket 29 allows compressed garments 17 to be inserted into sealed windowed envelopes 27 at a production facility and then tailored for different purposes and markets by selecting and inserting an appropriate insert 13 into the pocket 29. That tailoring may take place at the production facility or at a separate facility, possibly a local facility in a different country to the production facility.

It is also possible for a user to customise an envelope 27 upon or after purchase by inserting a suitable insert 13, which may for example be produced in accordance with a design chosen by the user, and/or a user-selected photograph. A user may even choose a design remotely, for example over the Internet, which design is applied to the envelope 27 by printing and inserting a suitable insert 13 at a despatch facility. The user need never see the package before it is personalised and sent directly from the despatch facility to the intended recipient.

In the alternative envelope 30 shown in FIGS. 5*a*, 5*b* and 5*c*, an insert 13 serves as both an information-bearing insert and as a postcard. Thus, the insert 13 may have one face bearing information for marketing purposes and the opposed face being a writing surface suitable for entering a mailing address and for bearing a postage stamp or equivalent marking. FIG. 5*c* shows the insert 13 removed, reversed and reinserted to show a postcard-printed side through the windowed pocket 29. Thus, for display at the point of sale as shown in FIG. 5*b*, the insert 13 may be oriented with the information-bearing surface 13 visible through the window 31 of the sleeve 29. After purchase, a user simply removes the insert 13, marks the postcard on the reverse with the mailing address of an intended recipient, and re-inserts it into the pocket 29 with the postcard face viewable through the window 31.

A further advantage of this arrangement is that the window provides protection to the insert 13, minimising the risk of damage to the insert 13 when the package is mailed.

In a variant of the arrangement shown in FIGS. 5*a*, 5*b* and 5*c*, the writing surface is attached to or formed integrally with a major face of the envelope 30 opposed to the windowed pocket 29. In that case, the information-bearing insert 13 may be inserted into the pocket 29 and a user can write on the writing surface on the other face of the envelope 30. Where the writing surface is attached to the envelope 30, different writing surfaces may be selectively attachable to the envelope 30 to enable personalisation.

Figure 6B:
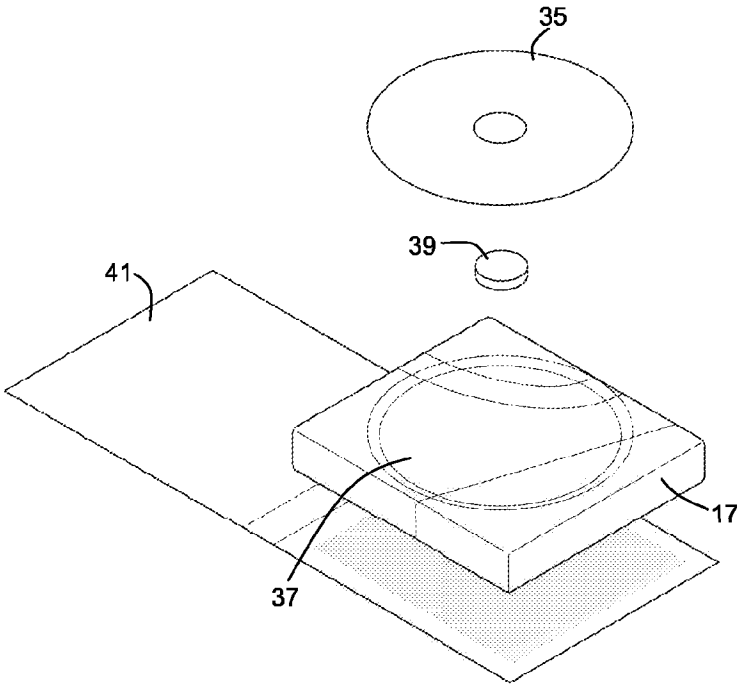
FIG. 6*b* is an exploded perspective view of the package and its contents shown in FIG. 6*a;*
Figure 6A:
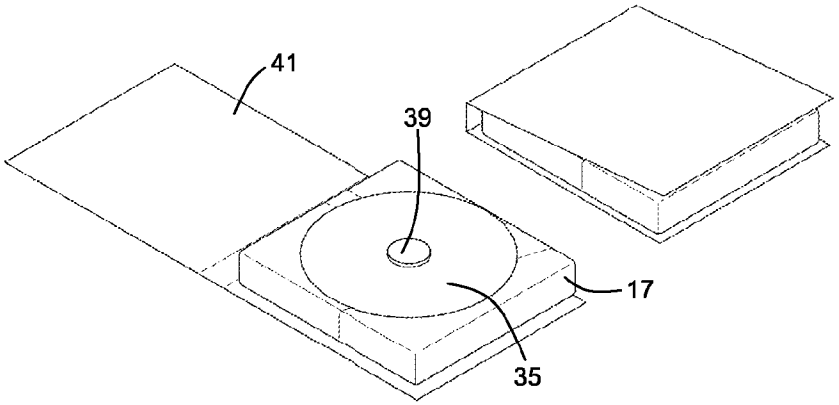
FIG. 6*a* is a perspective view that shows a compressed garment in an opened package, the garment supporting an optical disk such as a CD or DVD, and also showing the package when closed.

Moving on now to FIGS. 6*a* and 6*b* of the drawings, these show how a compressed garment 17 may be packaged in conjunction with another article and may optionally be adapted to suit that other article. In this example, the other article is an optical disk 35 such as a CD or DVD, packaged with the compressed garment 17 in a protective gatefold package 41 that suitably carries marketing information for retail purposes. The gatefold package 41 may also carry a writing surface such as a postcard for the entry of a mailing address and suitable postage, which again may be pre-paid.

In this example, the compressed garment 17 is adapted to suit the disk 35 in three optional ways. Firstly the tablet shape of the compressed garment 17 is square in plan view to match the symmetry of the disk 35; secondly a spindle or boss 39 is attached centrally to a major face of the compressed garment 17; and thirdly that major face of the compressed garment 17 is shaped to match and receive the disk 35 in a shallow circular recess or depression centred on the boss 39. Not all of these adaptations need be used together: some may be used individually.

The recess 37 may be impressed directly into the compressed garment 17 with a suitably-shaped die tool, and subsequently enclosed in shrink-wrap packaging 19. Alternatively, the compressed garment 17 may first be enclosed with shrink-wrap packaging 19, and subsequently impressed with the recess 37 in a second pressing operation. Thereafter the boss 39 is adhesively attached to the shrink-wrap packaging 19 centrally within the recess, to hold and protect the disk 35 within the recess 37, thereby preventing the disk 35 coming loose during transportation and mailing.

The reader will appreciate that the shape of the impressed recess will be complementary to the shape of the object being housed, and that various shapes of recess may be impressed into the compressed garment 17 depending on the shape of the object in question.

Figure 7A:
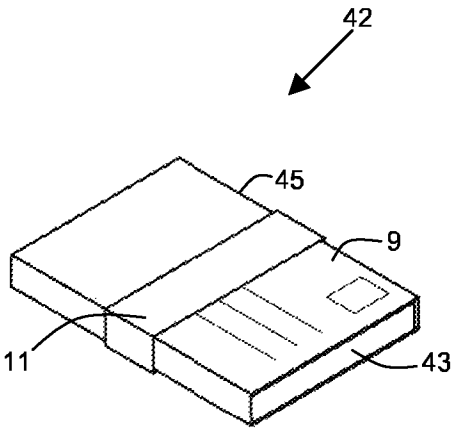
FIG. 7*a* is a perspective view of a compressed garment enclosed in a mailable package made from a folded sheet.

FIG. 7*a* shows a further alternative package 42 comprising a folded sheet of material 43. Preferably, the package 42 is made from a single integral sheet 43. Optionally, and as readily highlighted in the exploded view of the package and its constituent components of FIG. 7*b*, the package 42 comprises a sleeve 45, the sleeve 45 comprising a pair of opposed major faces 47 joined by a pair of opposed edge faces 49. In this example, one of the major faces 47 has a writing surface for entering a mailing address of an intended recipient and for bearing any necessary postage. The other major face of the sleeve 45 could have an information-bearing insert like that described in the preceding embodiments; similarly, a windowed pocket may be provided so that a single reversible insert may serve also as a postcard.

The sleeve 45 is arranged to receive the sheet 43 folded into a cuboidal package 42, and is arranged to maintain the package in that closed configuration. The dimensions of the sleeve 45 are complementary to the dimensions of the package 42. Specifically, the height 51 and the width 53 of the sleeve 45 are complementary to the thickness 57 and width 55 of the package 42 respectively when in the closed configuration. When inserted into the sleeve 45, the package 42 is held in the closed configuration by the sleeve 45. Optionally, the package 42 further comprises a bellyband 11 that slides around the sleeve for retail purposes and can be removed after purchase.

Figure 7B:
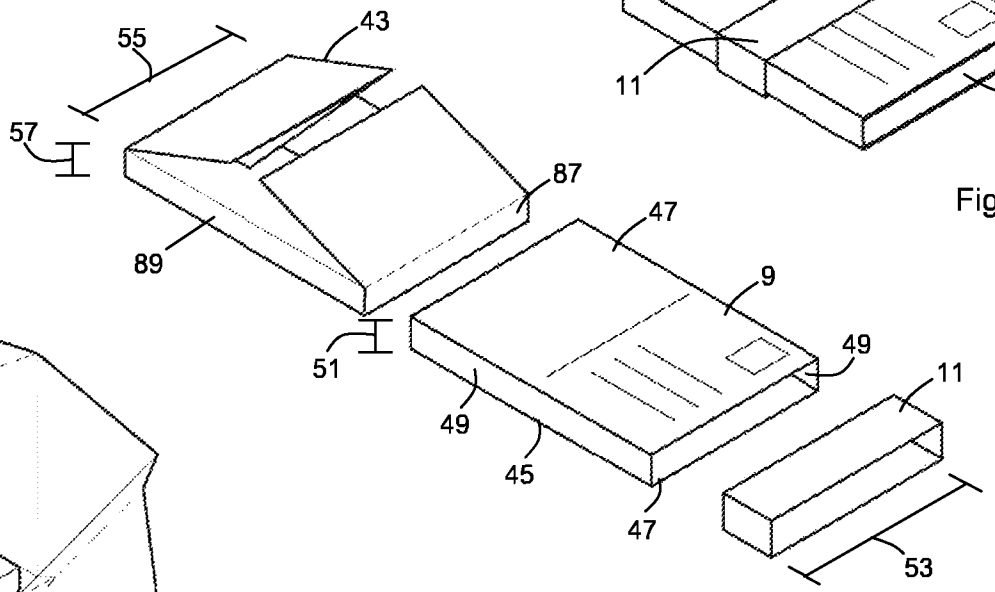
FIG. 7*b* is an exploded perspective view of the constituent components of the package of FIG. 7*a;*
Figure 7C:
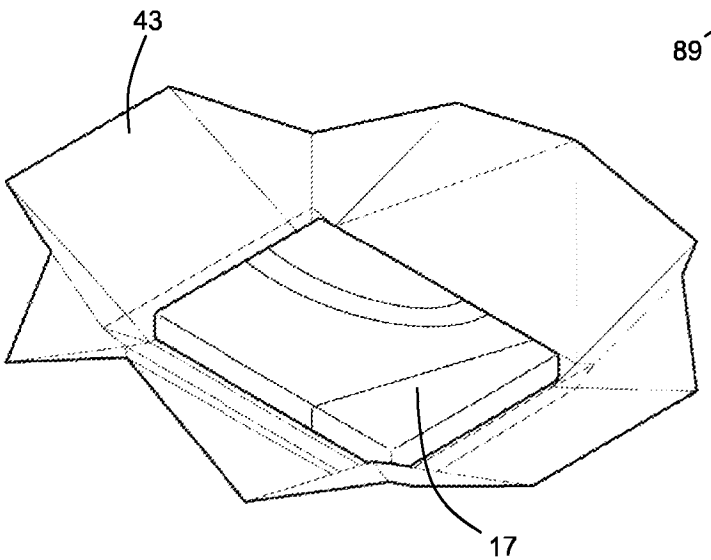
FIG. 7*c* is a perspective view of the folded-sheet package of FIGS. 7*a* and 7*b* in an open configuration.

FIG. 7*c* shows the sheet 43 of FIG. 7*a* in an open configuration, in which its content of (in this example) a compressed garment 17 is visible and accessible. Optionally the sheet 43 has a plain muted external colour such as white or grey so as not to attract unwelcome attention in the mail and so as to provide a clear background for a mailing address. However, in that case it is preferred that the internal side of the sheet 43 has a bright colour such as yellow or orange so as to frame the compressed garment 17 presented within and to add to the surprise and aesthetic pleasure experienced by the recipient upon opening the package 42.

Figure 8:
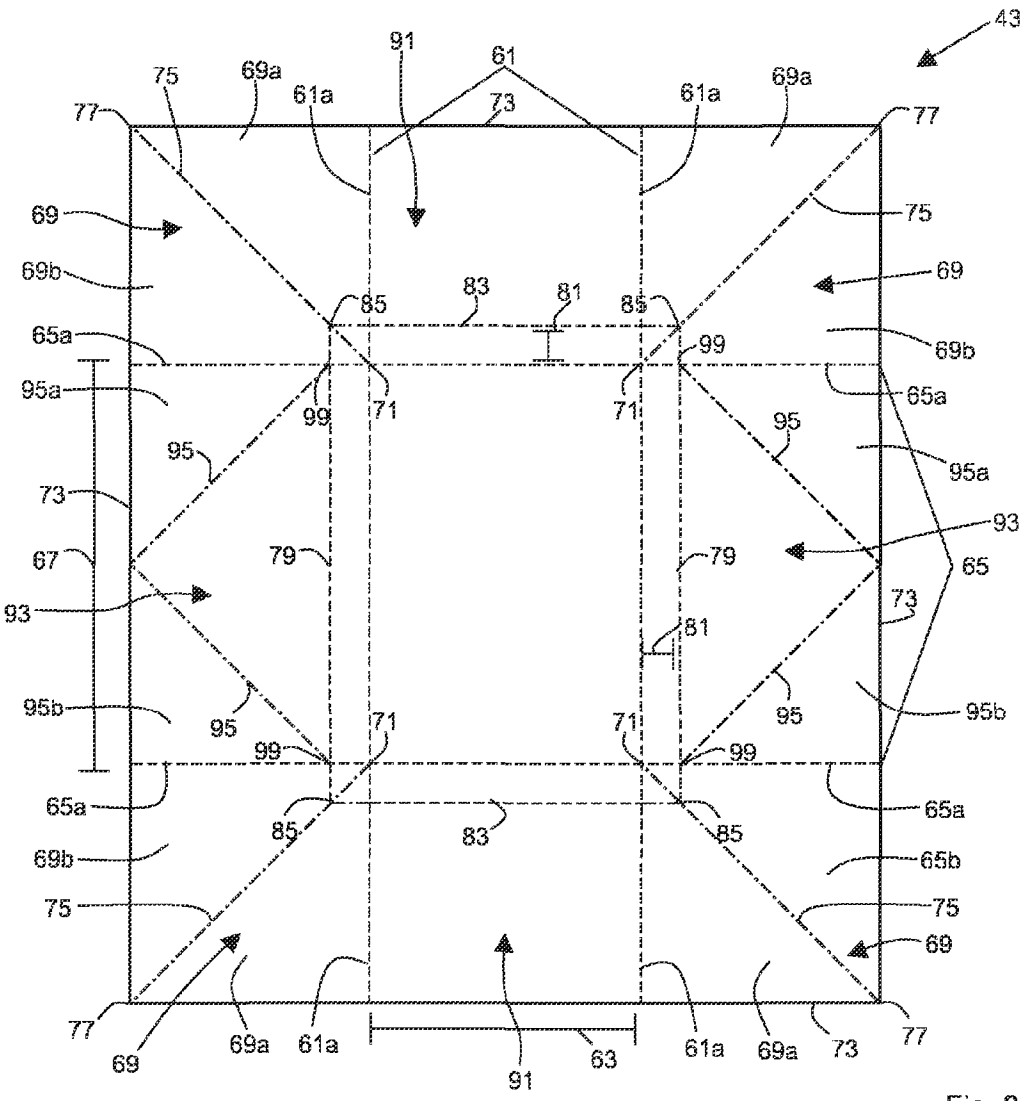
FIG. 8 is a plan view of a sheet marked with a plurality of fold lines for making the package of FIGS. 7*a*, 7*b* and 7*c;*

FIG. 8 shows the sheet 43 in an open configuration, in plan view. The sheet 43 has a plurality of fold lines that demarcate where the sheet 43 is folded to form the closed package of FIG. 7*a*. The illustrated embodiment is suitable for housing a rectangular cuboidal object such as the tablet-shaped compressed garment of FIGS. 1 to 6.

The sheet 43 is provided with a first pair of fold lines 61 extending the length of the sheet 43, in a substantially parallel arrangement, and separated by a distance 63. The separation distance 63 defines the width of the package when in a folded, closed configuration.

A second pair of substantially parallel fold lines 65 are provided on the sheet 43, separated by a distance 67. The second pair of fold lines 65 extend the width of the sheet 43, and are in substantially orthogonal relation to the first pair of fold lines 61. The separation distance 67 of the second pair of fold lines 65 defines the length of the package when in a folded, closed configuration.

Accordingly, the distances 65 and 67 between the fold lines 61 of the first pair and the fold lines 65 of the second pair respectively are selected in accordance with the desired dimensions of the object to be packaged, and specifically in accordance with the length and width of that object.

The first pair of fold lines 61 and the second pair of fold lines 65 effectively divide the sheet 43 into nine rectangular regions in a tiled arrangement. These regions comprise four web portions 69 each bounded by a respective corner of the sheet 43 and by an end segment 61*a* of one of the first fold lines 61 and an end segment 65*a* of one of the second fold lines 65. Each end segment 61*a*, 65*a* is defined between a point of intersection 71 of a first fold line 61 and a second fold line 65, and the boundary 73 of the sheet of material 43.

A further fold line 75 is provided between each point of intersection 71 and the respective nearest corner 77 of the sheet 43. Each fold line 75 separates its associated web portion 69 into first 69*a* and second 69*b* web portions.

The sheet 43 is further provided with a pair of first edge fold lines 79, arranged outwardly at a distance 81 from the first pair of fold lines 61. The first edge face fold lines 79 extend substantially parallel to the first pair of fold lines 61. Similarly, the sheet 43 has a pair of second edge fold lines 83, arranged outwardly at the same distance 81 from the second pair of fold lines 65. The pair of first edge fold lines 79 and the pair of second edge fold lines 83 intersect orthogonally at points 85 located on the fold lines 75 that separate the web portions 69 into first 69*a* and second 69*b* web portions.

The parallel rectangular areas bounded by the pair of first edge fold lines 79, the first pair of fold lines 61 and the second pair of fold lines 65 define first edge faces 89 of the package 42 when in a closed configuration. FIG. 7*b* shows one of the first edge faces 89.

Similarly, the parallel rectangular areas bounded by the pair of second edge fold lines 83, the first pair of fold lines 61 and the second pair of fold lines 65 define second edge faces 87 of the package 42 when in a closed configuration. FIG. 7*b* shows one of the second edge faces 87. The thickness or height of the first and second edge faces 87, 89 is determined by the equal distances 81 between a first edge fold line 79 and the adjacent first fold line 61 and between a second edge fold line 83 and the adjacent second fold line 65. It will be appreciated that these distances are equal to house a tablet-shaped compressed garment 17 within the package 42.

The rectangular area bound by the pair of first fold lines 61 and the pair of second fold lines 65, which in the illustrated embodiment of FIG. 8 are in orthogonal relation, defines a major face of the package 42. That face is integral with the pair of first edge faces 89 and the pair of second edge faces 87. These features together define an open-topped tray-like container when the sheet 43 is in an opened but not entirely flattened configuration.

A pair of first flaps 91 and a pair of second flaps 93 are provided to cover the open-topped container. These flaps 91, 93 are integral with the sheet 43.

The first flaps 91 are defined between the boundary 73 of the sheet 43, the end segments 61*a* of the first pair of fold lines 61, and the second edge fold lines 83. The second flaps 93 are defined between the boundary 73 of the sheet 43, the end segments 65*a* of the second pair of fold lines 65, and the first edge face fold lines 79.

The second flaps 93 are arranged to underlie the first flaps 91 when the package 42 is in a closed configuration. Furthermore, each of the first flaps 91 is integrally connected to both of the second flaps 93 by webs 69; it follows that each of the second flaps 93 is integrally connected to both of the first flaps 91 by webs 69.

In the closed configuration, each web 69 is arranged to lie between a neighbouring one of the first 91 and second flaps 93. In that configuration, the web 69 is folded into its constituent first 69*a* and second 69*b* web portions, arranged such that the second web portion 69*b* underlies the first web portion 69*a* in a collapsed state, with both web portions lying between the first flap 91 and the second flap 93.

To ensure that the open-topped container is substantially completely covered in the closed configuration, each second flap 93 is provided with two further fold lines 95 that extend in opposed directions. Each of the fold lines 95 extends from a point 97 on the boundary 73 of the sheet 43 mid-way along the length of the sheet, to a point of intersection 99 between a first edge fold line 79 and a fold line 65 of the second pair.

The fold lines 95 define second flap web portions 95*a* and 95*b*, each of which is arranged to underlie the web portions 69*a* and 69*b* of a web 69, and to overlie the second flap 93 when in the closed configuration.

Each point of intersection 99 is disposed outboard of an associated point of intersection 71, along an end segment 65*a* of a second fold line 65. Similarly, each point of intersection 85 is disposed outboard of an associated point of intersection 71, along a fold line 75 extending to the respective nearest corner 77 of the sheet 43.

Figure 9A:
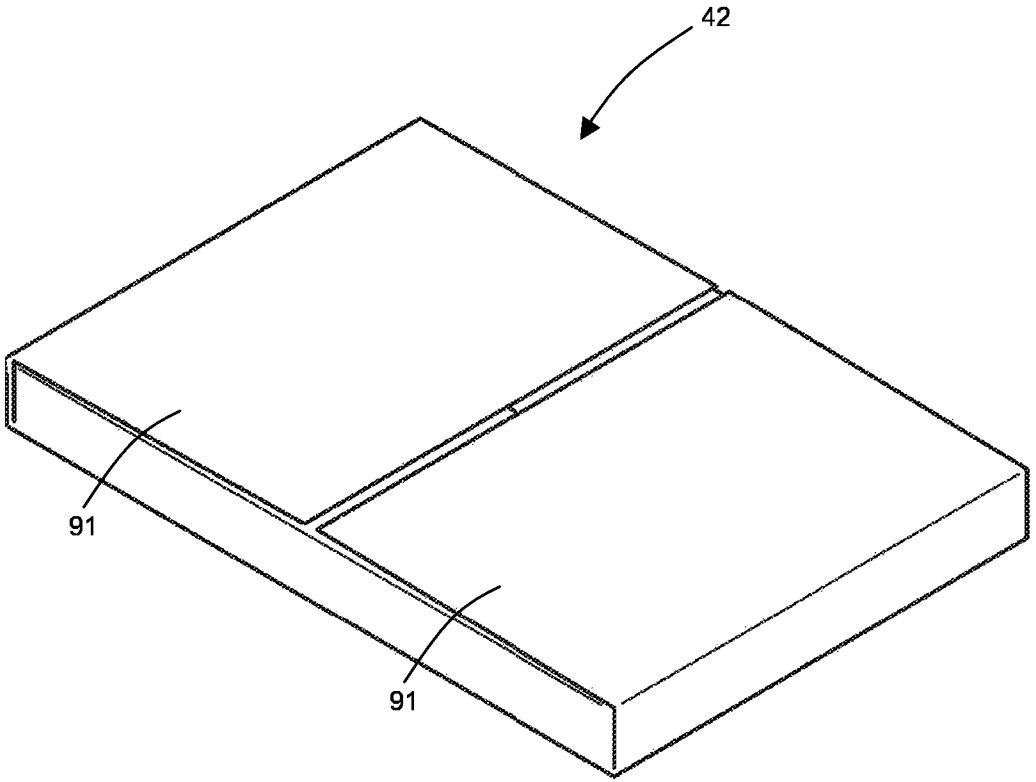
FIGS. 9*a* to 9*d* are a series of perspective views showing an opening sequence of the folded-sheet package of FIGS. 7*a*, 7*b* and 7*c;*
Figure 9B:
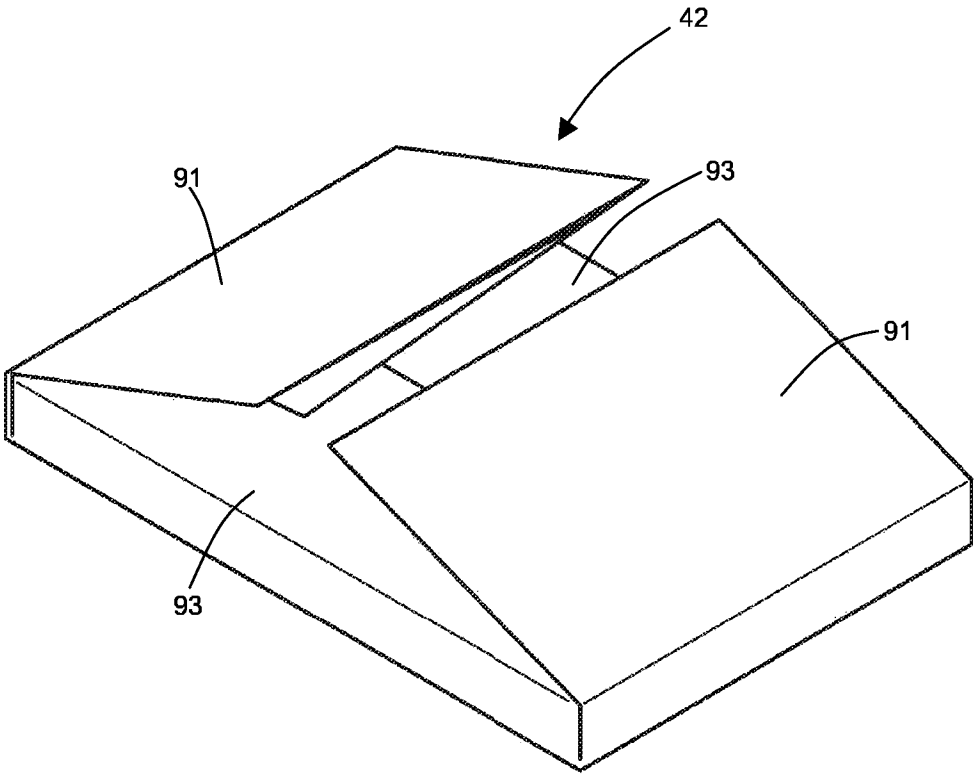
Figure 9C:
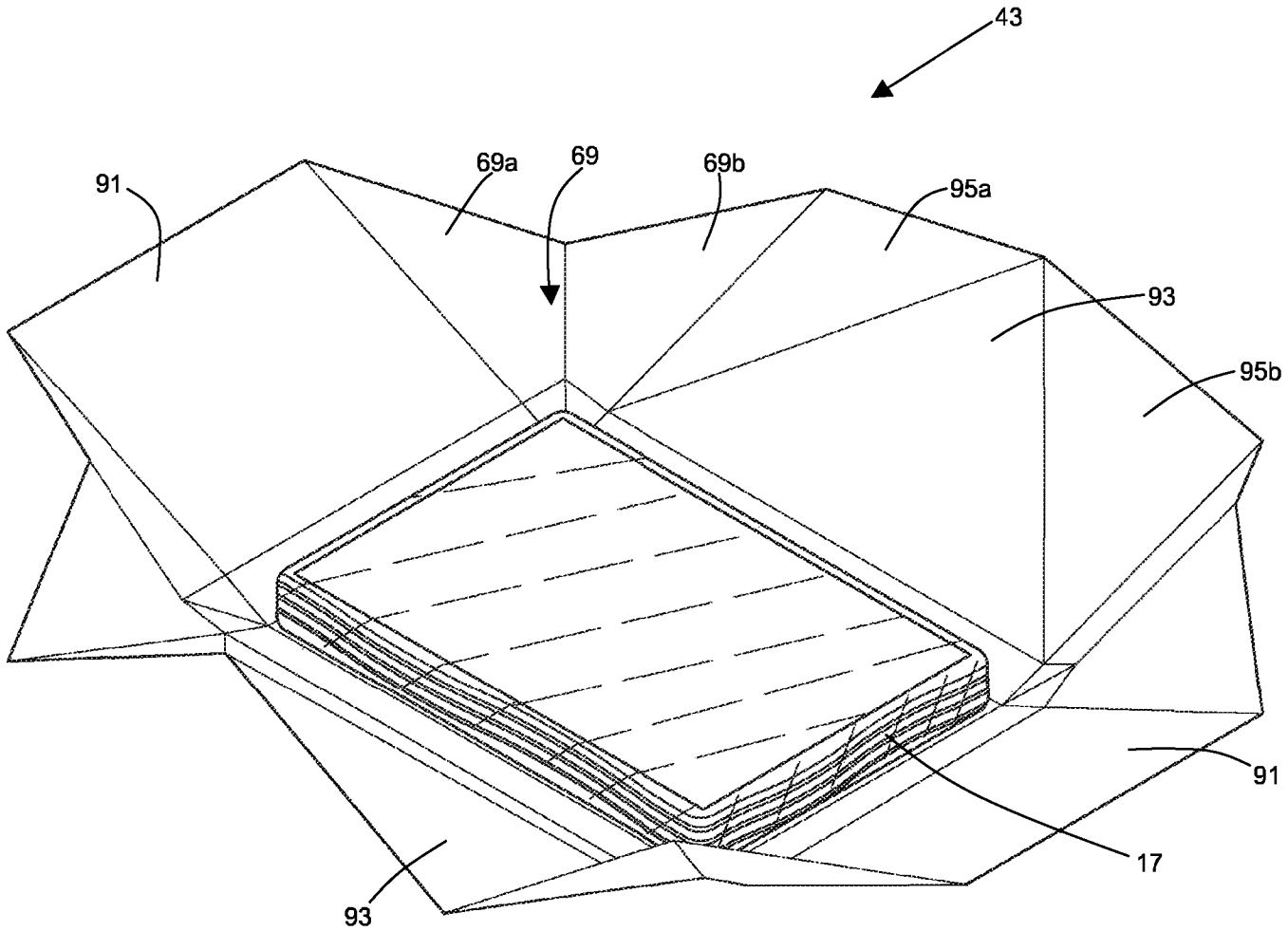
Figure 9D:
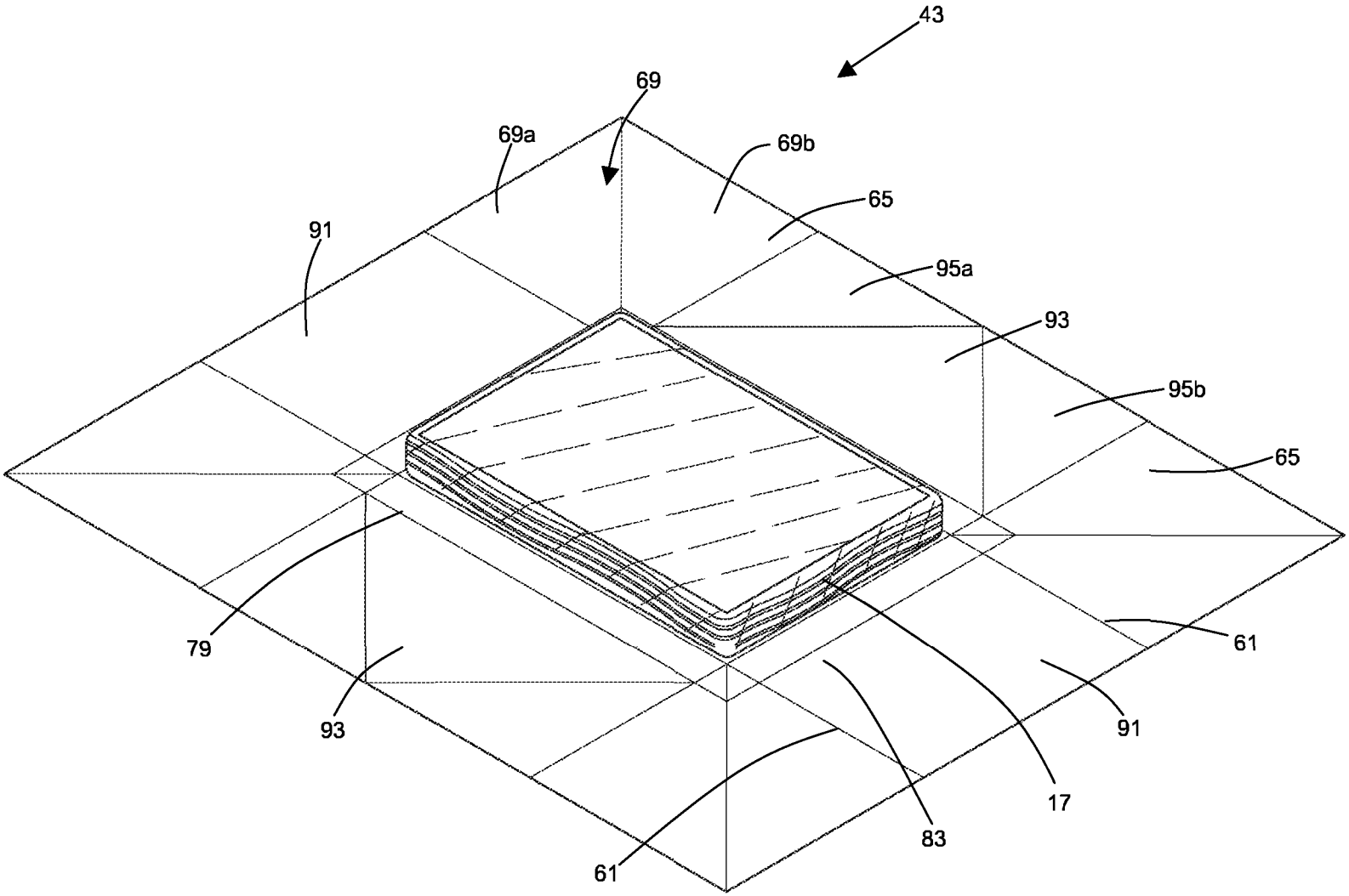

Thus, each web 69 is integrally connected directly to a first flap 91 and indirectly to a second flap 93. The webs 69 and the points of intersection 71, 85, 99 are arranged such that as the package 42 is transformed from a closed configuration to an open configuration as shown in FIGS. 9*a* to 9*d*, the webs 69 unfold in response to opening movement of the first flaps 91. This unfolding drives opening movement of the second flaps 93, thereby revealing and providing access to the storage volume of the package 42 as shown in FIGS. 9*b* to 9*d*. In this way the storage volume of the package may be accessed, its interior and contents having been revealed to the recipient in a particularly appealing and striking manner that emphasises the quality and value of the item packaged within.

Specifically, opening movement of the first flaps 91 causes the underlying first 69*a* and second 69*b* web portions to unfold, which causes the second flap web portions 95*a* and 95*b* to unfold, thereby driving opening movement of the second flaps 93. In other words, applying an opening movement to the first flaps 91 causes the second flaps 93 to unfold. This unfolding in response to an opening movement on the first flap results from the web 69 being integrally connected to both the first 91 and second 93 flaps, by means of the first 69*a* and second 69*b* web portions and the second flap web portions 95*a* and 95*b*. The outboard position of points of intersection 85 and 99 with respect to each point of intersection 71 also drives the unfolding mechanism.

Figure 10A:
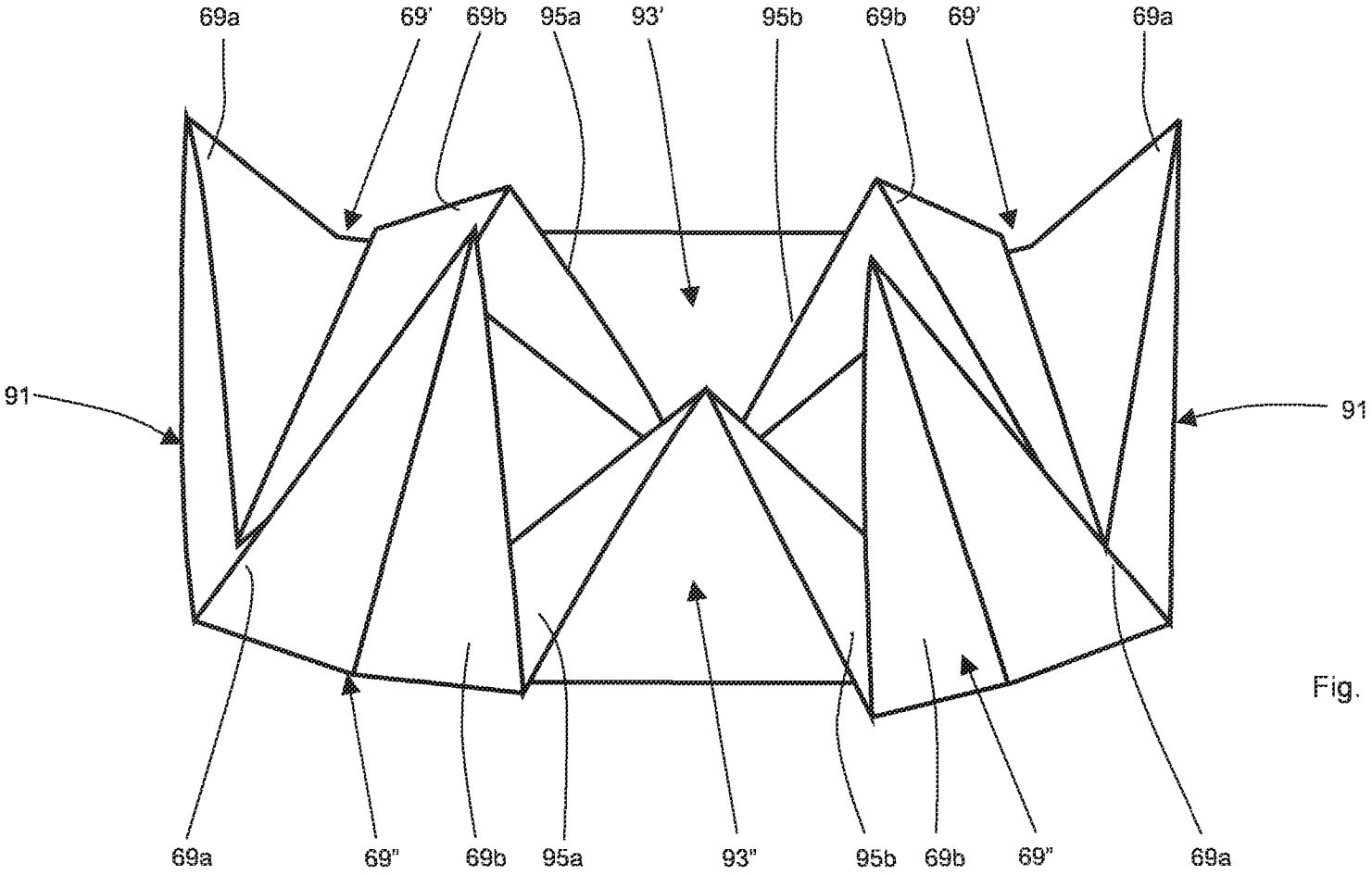
FIGS. 10*a* and 10*b* are plan views of the folded-sheet package of FIGS. 7*a*, 7*b* and 7*c* showing the interaction of interleaved webs of the package during the opening sequence.
Figure 10B:
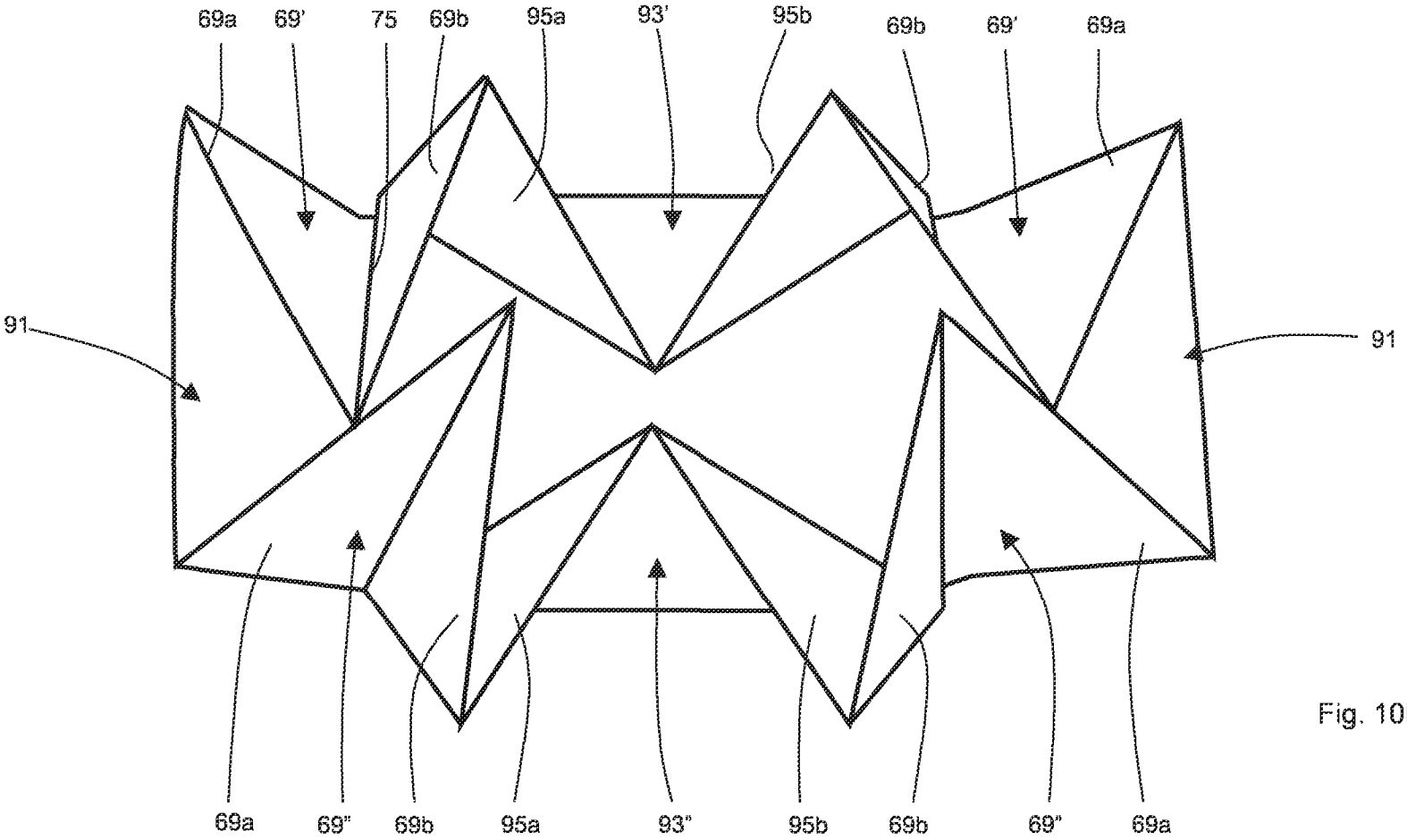

With reference to the semi-folded configurations shown in FIGS. 10*a* and 10*b*, the two webs 69 adjacent to an end flap 91 are referred to respectively as a first web 69' and a second web 69". Similarly, the two opposed second flaps 93 are referred to in FIGS. 10*a* and 10*b* as 93' and 93".

Each of the webs 69', 69" is folded into its constituent first and second web portions 69*a* and 69*b*. Furthermore, the webs 69', 69" adjacent to an end flap 91 are arranged in interleaved relation with respect to each other when in the folded and semi-folded configurations.

In the folded and semi-folded configurations, the first and second web portions 69*a*, 69*b* of the first web 69' are arranged in interleaved relation between the first web portion 69*a* of the second adjacent web 69" and the end flap 91. Also, the first and second web portions 69*a*, 69*b* of the second web 69", are arranged in interleaved relation between the second web portion 69*b* of the first web 69', and the second flap web portion 95*a* of the second flap 93". It is to be appreciated that the exact orientation of the different flap web portions is irrelevant, provided that the webs are in interleaved relation when in the folded and semi-folded configurations. Accordingly, in alternative embodiments, the first and second web portions 69*a*, 69*b* of a second web 69" may be arranged in interleaved relation between the first web portion 69*a* of the first adjacent web 69' and the end flap 91, and such alternatives fall within the scope of the present invention.

The two opposed second flaps 93', 93" are arranged in the folded and semi-folded configurations such that one of the second flaps 93', 93" abuts and overlies the other. Whilst FIG. 10*a* shows second flap 93" overlying opposed second flap 93', it is irrelevant which second flap 93', 93" overlies the other, and such alternatives fall within the scope of the present invention.

Where the second flap 93" overlies the opposed second flap 93', the second flap 93" and the associated second flap web portion 95*a* are interleaved between an opposed second flap web portion 95*a* of the opposed second flap 93' and the second web portion 69*b* of one of the second webs 69". Similarly, the second flap 93" and the associated second flap web portion 95*b* are interleaved between an opposed second flap web portion 95*b* of the opposed second flap 93' and the second web portion 69*b* of the other of the second webs 69".

The interleaved and abutting relationships between the various elements are advantageous because they provide a visually-intriguing and functionally-effective way of concealing and, on opening, revealing the contents of the package 42. In particular, pulling the end flaps 91 causes the interleaved and abutting elements to unfold and slide past each other with a ramp-like interaction, driving unfolding and hence a progressively developing revealing action.

The interior surface of the folded sheet 43 may comprise a writeable surface, preferably arranged in the rectangular area bounded by the first and second fold lines 61, 65. For example, a personalised message to the intended recipient may be inscribed on the surface. Similarly, indicia such as corporate logos or other markings may also be provided on the interior surface of the folded sheet of material 43. In this way as the package 42 is opened and the sheet 43 unfolds, the greeting message, the indicia and other markings inscribed on the interior surface are revealed to the user. To the extent that a message or other information is presented in the rectangular area bounded by the first and second fold lines 61, 65, that message or other information is revealed only when the compressed garment 17 or other item is lifted from the sheet 43. This further adds to the surprise and pleasure experienced by the recipient.

The herein described embodiments are for illustrative purposes only, and do not limit the present invention. Furthermore, alternative embodiments are envisaged, including embodiments comprising any combination of the features described herein, and such alternative embodiments fall within the scope of the present invention.

Figure 11:
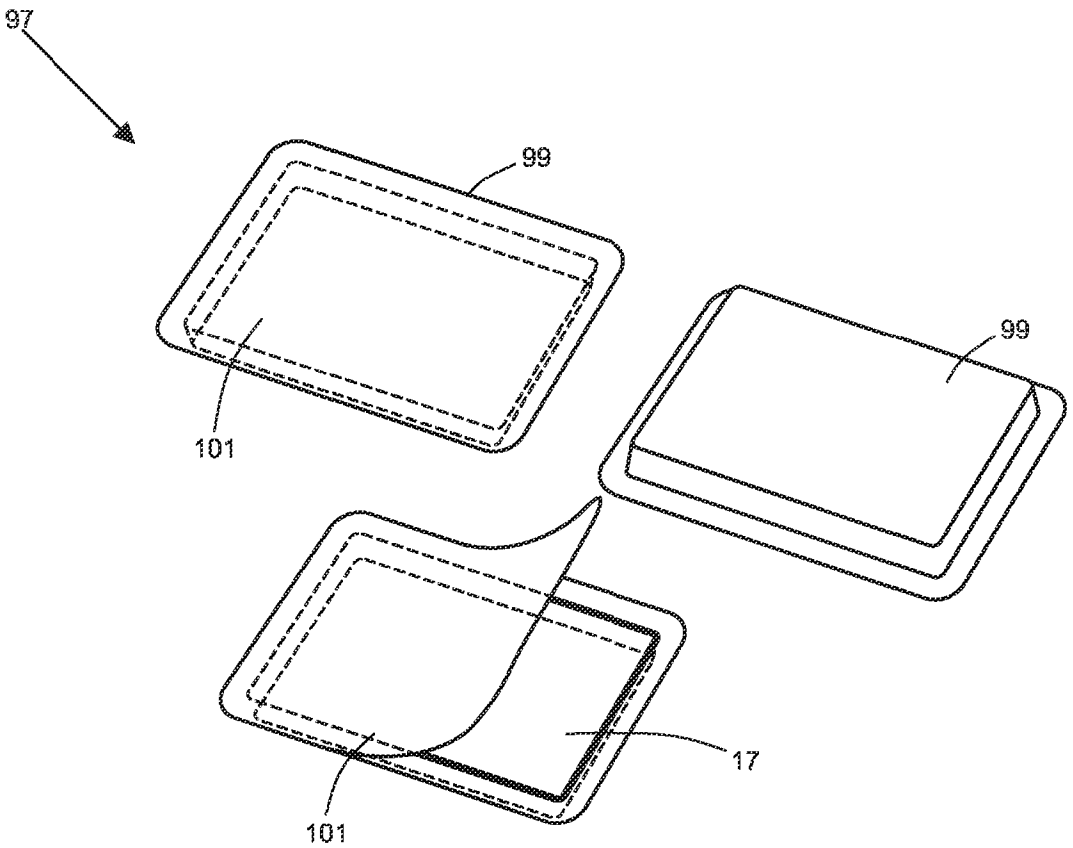
FIG. 11 is a set of perspective views of a further alternative mailable compressed garment package.

For example, FIG. 11 illustrates an alternative package 97, wherein the compressed garment 17 is housed in a tablet-shaped tray-like container 99 having a peelable foil or plastics lid 101 for accessing the contents of the container in the manner of a blister pack.

Figure 12:
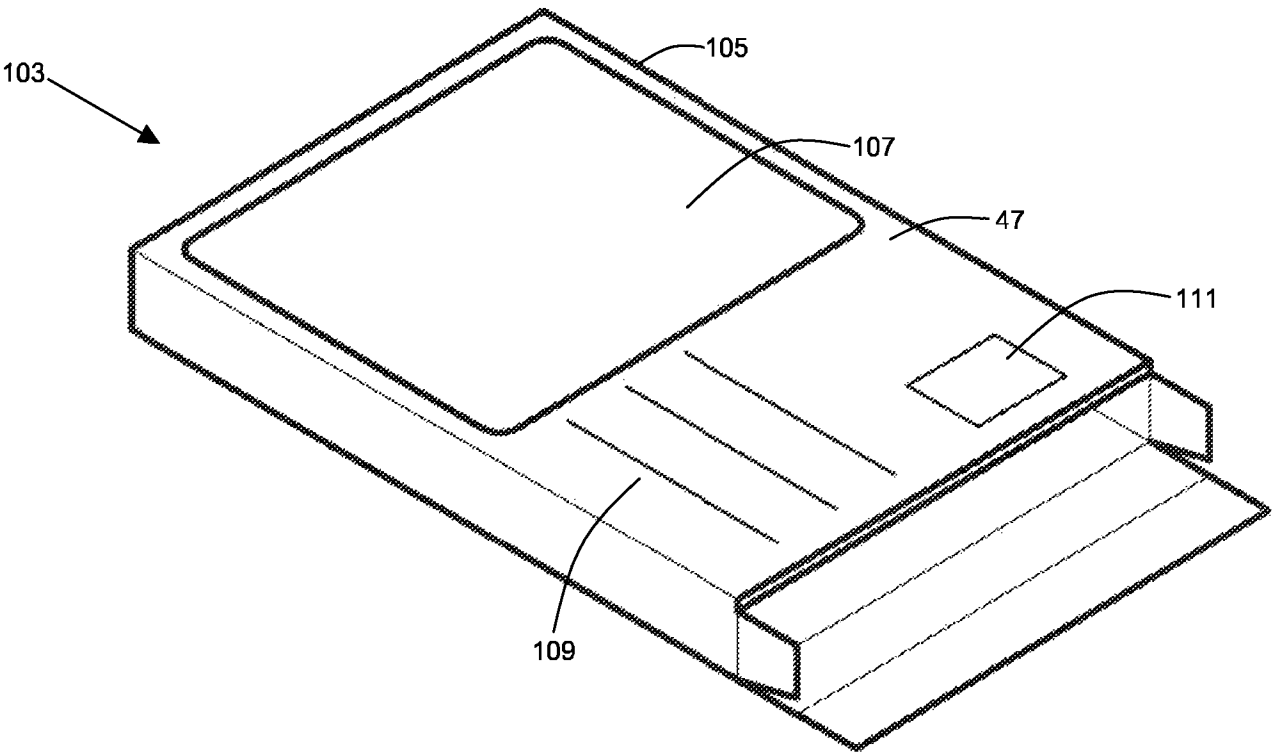
FIG. 12 is a perspective view of another alternative mailable compressed garment package.
Figure 13B:
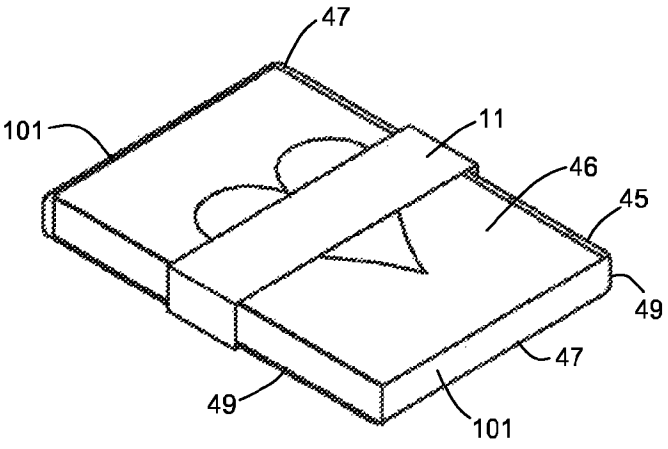
FIG. 13*b* is a perspective view of the bottom face of the mailable compressed garment package of FIG. 13*a;*
Figure 13A:
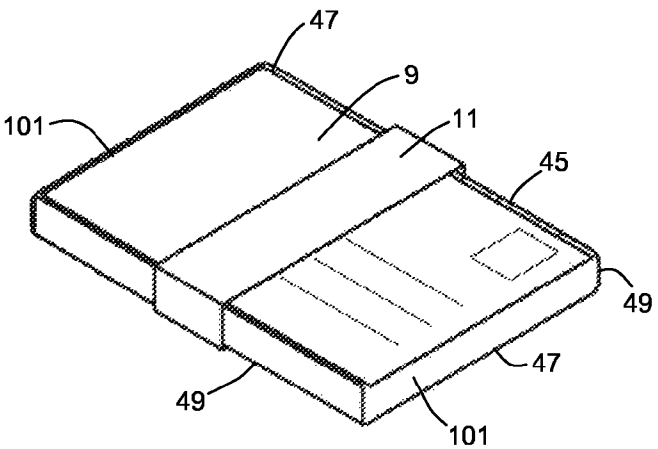
FIG. 13*a* is a perspective view of the top face of another alternative mailable compressed garment package.
Figure 13C:
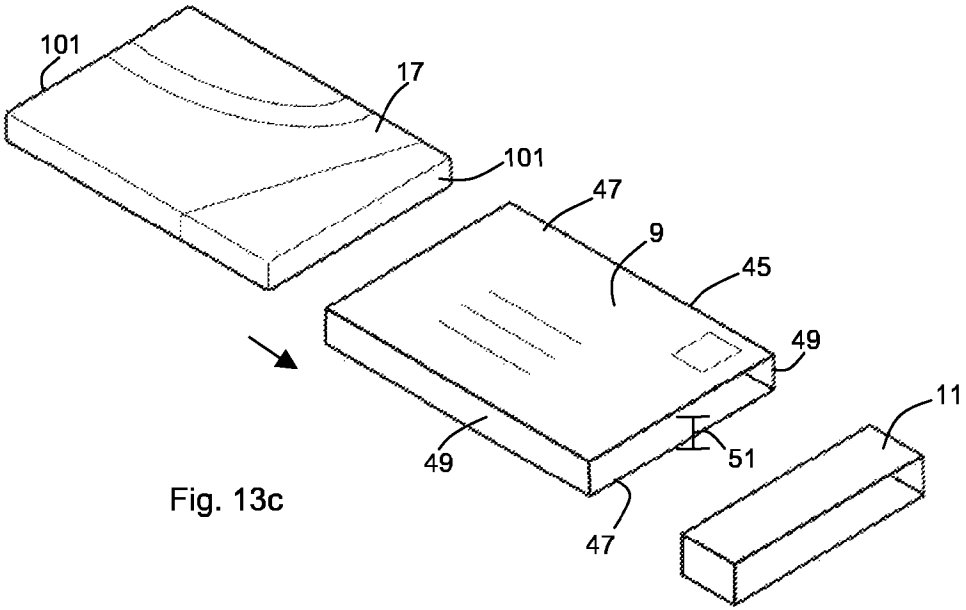
FIG. 13*c* is an exploded perspective view of the components of the alternative mailable compressed garment package of FIGS. 13*a* and 13*b*, during assembly.
Figure 13D:
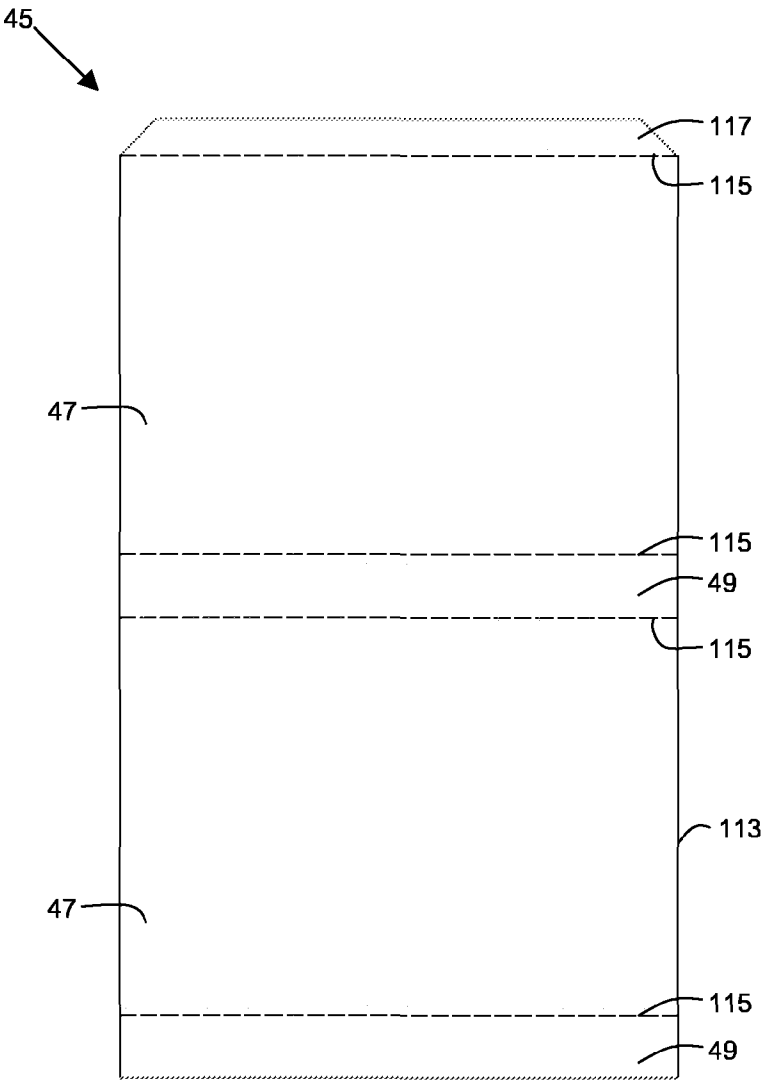
FIG. 13*d* is a plan view of a sleeve of the package of FIGS. 13*a*, 13*b* and 13*c* in an unfolded configuration.

FIG. 12 illustrates a further alternative of housing the compressed garment in a tablet-shaped windowed envelope 103, having a pocket 105 with an outwardly-facing transparent window 107, which covers only about half of a major face 47 of the envelope 103. The pocket 105 is for displaying an information-bearing insert, which may be reversible, interchangeable and customisable in the same manner as in previous embodiments. The remaining portion of that major face 47 has a printed writing surface 109 formed integrally with the major face 47 of the envelope 103, which also has space 111 to affix a postage stamp or bears a pre-printed, pre-paid postage marking.

Finally, FIGS. 13*a*, 13*b*, 13*c* and 13*d* illustrate a further alternative in which a compressed garment 17, packaged in shrink-wrap, is inserted into a sleeve 45. The sleeve 45 comprises two opposed major faces 47 joined by a pair of opposed edge faces 49. One of the major faces 47 has a postcard 9 attached to, formed integrally with or printed on the sleeve 45, for entering a mailing address of an intended recipient and for displaying any necessary postage. The other major face of the sleeve 45 has an information-bearing surface attached to, formed integrally with or printed on the sleeve 45.

Once inserted into the sleeve 45, all but a pair of opposed edge faces 101 of the compressed garment 17 are covered by the sleeve 45. The garment 17 may be secured in place within the sleeve 45 by placing on one or both edge faces 101 an adhesive sticker or label attached to both that edge face 101 and the sleeve 45. An optional bellyband 11 may be slid over the sleeve 45, as described in previous embodiments.

An advantage of this embodiment is that the compressed garment 17 and the sleeve 45 may be manufactured at separate locations, and by separate manufacturers, and combined at a later stage prior to resale. The height 51 of the sleeve 45 may be adjusted to match the height of the compressed garment 17. This is an important feature where for example, the sleeve 45 is intended for use with different types of compressed garment, each different type having a different thickness. Even where the compressed garments are nominally the same, there may be some variation in thickness between different compressed garment items. One way of dealing with this variation in the thickness of a compressed garment is to make the sleeve 45 once the specific compressed garment for use with the sleeve 45 has been selected. For example, the sleeve 45 may be made by the retailer prior to displaying the packaged garment for display.

The sleeve 45 comprises a rectangular sheet 113 of cardboard or similar material, comprising four appropriately-spaced parallel fold lines 115. The fold lines 115 bound rectangular areas that define respectively the pair of major faces 47, the pair of edge faces 49, and an edge-face overlap 117.

The sleeve 45 is made by folding the sheet in accordance with the fold lines 115. One of the edge faces 49 at an end of the sheet 113 is overlaid by the edge-face overlap 117 at the other end of the sheet 113, and secured by an adhesive placed between the edge face 49 and the edge-face overlap 117, to prevent the sleeve 45 from unfolding. The dimensions of the sleeve 45 may be varied to compensate for varying thickness between compressed garments simply by increasing or decreasing the amount of overlap between the edge face 49 and the edge-face overlap 117.

A further advantage is that the sleeve 45 is free-standing as a result of the opposed edge faces 49 being orthogonally oriented with respect to the major faces 47, and may be considered a three-dimensional postcard.

A variation of the embodiments illustrated in FIGS. 4, 5*a*, 5*b* and 5*c* may comprise replacing the envelope with a carton having opposed major faces joined by an edge portion, and defining a storage volume suitable for housing a compressed garment or other tablet-shaped object.

A variation of the embodiment illustrated in FIGS. 5*a*, 5*b* and 5*c* may comprise a windowless pocket—in effect an open-fronted frame—arranged on a major surface of the package, or formed integrally therewith, and having an outwardly facing cut-out region to enable the contents of the pocket to be viewed through the cut-out region. A writing surface, including a postcard and/or an information-bearing surface may be inserted within the pocket as described in previous embodiments.

A further variation of the embodiment illustrated in FIGS. 7, 8 and 9 comprises at least one adhesive strip affixed to both end flaps 91 when in a folded configuration, to maintain the package in the closed configuration. Similarly, a perforated, removable, sealing strip may be affixed to both end flaps 91 when in the folded configuration, to maintain the package in the closed configuration. To open the package, the perforated strip is removed.

Alternative eco-friendly versions of the present embodiments are also envisaged, wherein the constituent components of the package are all manufactured from biodegradable materials, such as cardboard, corn paper and/or rice paper. In such embodiments, shrink-wrapping is not used although biodegradable plastics wrapping materials could be used instead. For example, rye starch film or corn starch film may be used in place of shrink-wrapping.

The reader will appreciate that whilst the functional utility of the herein described package is for housing a tablet-shaped object such as a compressed garment, the compactness and nature of the package is itself appealing, and is therefore suitable for being kept by the user as a memento. An advantage in this respect is that in some embodiments, the package may be stood stably on an edge to display a message, graphics or other information in the manner of a postcard, picture or greetings card.

Furthermore, the customisable features of the package render it ideal for use as a personalised gift. For example, and as described previously the information bearing insert may be customised with a user-selected picture, design or other image. Similarly, the folded sheet of the package illustrated in FIGS. 7*a*, 7*b*, 7*c*, 8, 9*a*, 9*b*, 9*c*, 10*a* and 10*b* may be customised by the user to personalise the package. For example, a user-selected drawing, image or other visually-appealing representation may be provided on the sheet. In this way, when the intended recipient opens the package the customised drawing, image or other visually appealing representation is revealed to the recipient.

The invention claimed is:

1. A package made from a folded sheet, the package comprising:

an open-topped cuboid storage volume bounded by a major face surrounded by an edge portion;

a pair of upper flaps that are integral with, and are each movable with respect to, the edge portion to cover the open top of the storage volume when in a closed configuration; and first and second lower flaps that are integral with, and are movable with respect to, the edge portion to cover at least part of the open top of the storage volume while underlying the pair of upper flaps, when in the closed configuration;

wherein the pair of upper flaps are integrally connected to the first and second lower flaps by first and second primary webs respectively that unfold, slide past and interact with each other in response to opening movement of the pair of upper flaps, the opening movement of the pair of upper flaps driving opening movement of the first and second lower flaps in directions orthogonal to the opening movement of the pair of upper flaps, to uncover the open top of the storage volume thereby to reveal and provide access to the storage volume.

2. The package of claim 1, wherein the first primary web associated with the first lower flap oppose and interlock with the second primary web associated with the second lower flap to define an opposed interlocking saw-tooth profile between the first and second primary webs.

3. The package of claim 2, wherein the first and second primary webs disengage from each other with continued opening movement of the pair of upper flaps.

4. The package of claim 1, wherein the first and second primary webs interact with each other with a ramp action.

5. The package of claim 1, wherein each primary web comprises a first web portion and a second web portion joined by a fold, and by respective secondary webs each joined by a fold to the second web portion of the respective primary web; and in closed and partially-opened configurations:

the first primary web lies between one of the pairs of upper flaps and a first web portion of the second primary web;

the second primary web lies between a second web portion of the first primary web and a secondary web associated with the first lower flap; and the first lower flap lies between a second web portion of the second primary web and a secondary web associated with the second lower flap.

6. The package of claim 1 having a thickness substantially equal to a height of the edge portion.

7. The package of claim 1, wherein the folded sheet is rectangular and has a width and a length, and comprises:

a substantially parallel pair of first fold lines separated by a first distance, and extending along the length of the sheet; and a substantially parallel pair of second fold lines separated by a second distance, extending across the width of the sheet;

wherein first and second fold lines are in mutually orthogonal intersecting relation, and divide the sheet into a plurality of regions in a tiled arrangement.

8. The package of claim 7, wherein each first fold line comprises at least one first end segment, and each second fold line comprises at least one second end segment, the first end segment and the second end segment being in mutually orthogonal relation and each end segment being defined between a point of intersection of first and second fold lines and a nearest boundary of the sheet.

9. The package of claim 5, wherein the folded sheet is rectangular and has a width and a length, and comprises:

a substantially parallel pair of first fold lines separated by a first distance, and extending along the length of the sheet; and a substantially parallel pair of second fold lines separated by a second distance extending across the width of the sheet;

first and second fold lines are in mutually orthogonal intersecting relation, and divide the sheet into a plurality of regions in a tiled arrangement; and each first fold line comprises at least one first end segment, and each second fold line comprises at least one second end segment, the first end segment and the second end segment being in mutually orthogonal relation and each end segment being defined between a point of intersection of first and second fold lines and a nearest boundary of the sheet; and wherein the sheet comprises at least one corner bounding an area also bounded by a first end segment and a second end segment, which area defines the first and second primary web.

10. The package of claim 9, wherein the sheet comprises four corners, and each first fold line comprises two first end segments at mutually-opposed ends of the first fold line, and each second fold line comprises two second end segments at mutually-opposed ends of the second fold line, such that a pair of first and a pair of second primary webs are defined.

11. The package of claim 7, wherein a region bounded by the intersecting pairs of fold lines defines the major face, when the sheet is in the folded configuration.

12. The package of claim 5 wherein the folded sheet comprises:

a substantially parallel pair of first fold lines separated by a first distance, and extending along the length of the sheet; and a substantially parallel pair of second fold lines separated by a second distance, extending across the width of the sheet;

wherein first and second fold lines are in mutually orthogonal intersecting relation, and divide the sheet into a plurality of regions in a tiled arrangement; and wherein the fold joining the first and second web portions of a primary web extends from a point of intersection of a first fold line and a second fold line, to a nearest corner of the sheet.

13. The package of claim 7, wherein the edge portion comprises first and second edge faces in intersecting relation.

14. The package of claim 13, wherein each of the first and second primary web comprises first and second web portions joined by a fold and by respective secondary webs each joined by a fold to the second web portion of the respective primary webs, and the folded sheet comprises:

a pair of first edge fold lines disposed outboard of, and extending substantially parallel to, the pair of first fold lines; and a pair of second edge fold lines disposed outboard of, and extending substantially parallel to, the pair of second fold lines;

wherein a first edge fold line and a second edge fold line intersect orthogonally at a point located on the fold joining the first and second web portions.

15. The package of claim 14, wherein the intersection between the first edge fold line and the second edge fold line lies outboard of the intersection between a first fold line and a second fold line.

16. The package of claim 14, wherein the first edge fold line, one of the pair of the first fold lines, and the pair of second fold lines bound a rectangular area, the rectangular area defining the first edge face.

17. The package of claim 14, wherein the second edge fold line, one of the pair of second fold lines, and the pair of first fold lines bound a rectangular area, the rectangular area defining the second edge face.

18. The package of claim 5 wherein the folded sheet comprises:

a pair of first edge fold lines disposed outboard of and extending substantially parallel to, the pair of first fold lines; and a pair of second edge fold lines disposed outboard of and extending substantially parallel to, the pair of second fold lines;

wherein a first edge fold line and a second edge fold line intersect orthogonally at a point located on the fold joining the first and second web portions; and wherein a secondary web fold extends from a point on the boundary of the sheet to an intersection between a first edge fold line and a second fold line.

19. The package of claim 18, wherein the intersection between a first edge fold line and a second fold line lies outboard of the intersection between a first fold line and a second fold line.

20. The package of claim 1, wherein the package comprises an information-bearing surface arranged to convey information.

21. The package of claim 20, wherein the information-bearing surface is disposed, on the interior surface of the folded sheet, such that the information-bearing surface is revealed when the package is opened.

22. The package of claim 20, wherein the information-bearing surface is disposed on the major face.

23. The package of claim 22, wherein the information-bearing surface is formed integrally with an interior side of the major face.

24. The package of claim 1, comprising an address surface for providing a mailing address of an intended recipient.

25. The package of claim 24, wherein the address surface is formed integrally with and disposed on an exterior side of the major face.

26. The package of claim 24, wherein the address surface comprises a postcard that is detachably attached to the major face.

27. The package of claim 24, wherein the address surface comprises a region for providing a postage marking.

28. The package of claim 27, wherein the postage marking is a pre-paid postage marking representing postage sufficient to mail the package in the country where the package is sold.

29. The package of claim 1, wherein the package has a a length and a width, and thickness that is less than its length and width.

30. The package of claim 29, wherein the area of the major face of the package is greater than the aggregate area of the edge portion.

31. The package of claim 1 and having a width no greater than 250 mm.

32. The package of claim 1 and having a thickness no greater than 25 mm.

33. The package of claim 1 and having a length no greater than 353 mm.

34. The package of claim 1, wherein the storage volume is arranged to house a flat tablet-shaped object.

35. The package of claim 1, wherein the storage volume is arranged to house a compressed garment in the form of a flat tablet.

36. The package of claim 1, comprising a sleeve or band arranged to receive the package as a close sliding fit, and to maintain the at least one upper flap in a closed configuration.

37. The package of claim 1, comprising a reversible insert on the major face of the package bearing retail information on one side and an address surface on an opposed side for providing a mailing address of an intended recipient, the insert being reversible after purchase to enter the mailing address on that major face of the package.

38. The package of claim 1, wherein the package is made from a rectangular folded sheet.

39. In combination, a package and an item, the package being made from a folded sheet and comprising:

an open-topped cuboid storage volume bounded by a major face surrounded by an edge portion;

a pair of upper flaps that are integral with, and are each movable with respect to, the edge portion to cover the open top of the storage volume when in a closed configuration;

first and second lower flaps that are integral with, and are movable with respect to, the edge portion to cover at least part of the open top of the storage volume while underlying the pair of upper flaps, when in a closed configuration, wherein the pair of upper flaps are integral connected to the first and second lower flaps by first and second primary webs respectively that unfold, slide past and interact with each other in response to opening movement of the pair of upper flaps, the opening movement of the pair of upper flaps driving opening movement of the first and second lower flaps in directions orthogonal to the opening movement of the pair of upper flaps, to uncover the open top of the storage volume thereby to reveal and provide access to the storage volume; and wherein the item is contained in the storage volume.

40. The combination of claim 39, when the item is a compressed garment.

41. A sheet of foldable material having a plurality of fold lines, the sheet being arranged, when folded in accordance with the plurality of fold lines, to form a package comprising:

an open-topped cuboid storage volume bounded by a major face surrounded by an edge portion;

a pair of upper flaps that are integral with, and are each movable with respect to, the edge portion to cover the open top of the storage volume when in a closed configuration; and first and second lower flaps that are integral with, and are movable with respect to, the edge portion to cover at least part of the open top of the storage volume while underlying the pair of upper flaps, when in the closed configuration;

wherein the pair of upper flaps are integrally connected to the first and second lower flaps by first and second primary webs respectively that unfold slide past and interact with each other in response to opening movement of the pair of upper flaps, the opening movement of the pair of upper flaps driving opening movement of the first and second lower flaps in directions orthogonal to the opening movement of the pair of upper flaps, to uncover the open top of the storage volume thereby to reveal and provide access to the storage volume.

* * * * *